US008833882B2

(12) United States Patent
Seo et al.

(10) Patent No.: US 8,833,882 B2
(45) Date of Patent: Sep. 16, 2014

(54) REFRIGERATOR

(71) Applicants: Woonkyu Seo, Changwon-si (KR); Seonkyu Kim, Changwon-si (KR); Seungjin Yoon, Changwon-si (KR); Jungyeon Hwang, Changwon-si (KR); Daesung Lee, Changwon-si (KR)

(72) Inventors: Woonkyu Seo, Changwon-si (KR); Seonkyu Kim, Changwon-si (KR); Seungjin Yoon, Changwon-si (KR); Jungyeon Hwang, Changwon-si (KR); Daesung Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/656,923

(22) Filed: Oct. 22, 2012

(65) Prior Publication Data

US 2013/0119844 A1 May 16, 2013

(30) Foreign Application Priority Data

Nov. 15, 2011 (KR) ..... 10-2011-0118861

(51) Int. Cl.
*A47B 96/04* (2006.01)
*F25D 23/04* (2006.01)

(52) U.S. Cl.
CPC ..... *F25D 23/04* (2013.01)
USPC ..... 312/405.1; 312/321.5

(58) Field of Classification Search
USPC ..... 312/401, 404, 405, 405.1, 321.5
See application file for complete search history.

(56) References Cited

U.S. PATENT DOCUMENTS

| | | | | | |
|---|---|---|---|---|---|
| 4,616,891 | A * | 10/1986 | Jantzen | 312/328 |
| 4,798,425 | A * | 1/1989 | Armstrong et al. | 312/321.5 |
| 5,069,342 | A * | 12/1991 | Dickinson | 206/372 |
| 5,370,453 | A * | 12/1994 | Wolff | 312/217 |
| 6,742,855 | B2 * | 6/2004 | Whitaker et al. | 312/405.1 |
| 6,908,163 | B1 * | 6/2005 | Hebeler et al. | 312/405.1 |
| 7,070,249 | B2 * | 7/2006 | Leimkuehler et al. | 312/405.1 |
| 7,111,914 | B2 * | 9/2006 | Avendano | 312/405.1 |
| 7,350,886 | B2 * | 4/2008 | Antos et al. | 312/404 |
| 7,552,983 | B2 * | 6/2009 | Shin | 312/405.1 |
| 7,775,613 | B2 * | 8/2010 | Williams | 312/321.5 |
| 2004/0012314 | A1 * | 1/2004 | Hay et al. | 312/405.1 |
| 2005/0116596 | A1 | 6/2005 | Leimkuehler et al. | 312/405.1 |
| 2006/0061247 | A1 * | 3/2006 | Lee et al. | 312/404 |
| 2010/0270902 | A1 * | 10/2010 | Kim et al. | 312/405.1 |

FOREIGN PATENT DOCUMENTS

| | | | |
|---|---|---|---|
| CN | 1766497 | A | 5/2006 |
| KR | 10-2004-0080878 | A | 9/2004 |
| KR | 10-2006-0000786 | A | 1/2006 |
| KR | 10-2007-0097826 | A | 10/2007 |

OTHER PUBLICATIONS

Chinese Office Action dated Jul. 11, 2014 issued in Application No. 201210426330.8 (with English translation).

* cited by examiner

*Primary Examiner* — Daniel Rohrhoff
(74) *Attorney, Agent, or Firm* — KED & Associates, LLP

(57) ABSTRACT

A refrigerator is provided. The refrigerator may include a cabinet, a door rotatably coupled to the cabinet, and a plurality of baskets each coupled to an interior side of the door. Each basket may include upwardly inclined bottom surface such that an upper one of a pair of vertically-adjacent baskets does not interfere with the basket below it.

16 Claims, 7 Drawing Sheets

REFRIGERATOR

CROSS-REFERENCE TO RELATED APPLICATION(S)

This application claims priority under 35 U.S.C. §119 to Korean Patent Application No. 10-2011-0118861, filed on Nov. 15, 2011, whose entire disclosure is hereby incorporated by reference.

BACKGROUND

1. Field

This relates to a refrigerator, and more particularly, to a basket structure for a door of a refrigerator.

2. Background

Generally, a refrigerator stores items in a frozen or refrigerated state by lowering an internal temperature of a compartment thereof through discharge of cold air generated by a refrigeration cycle including a compressor, a condenser, and an expansion valve, and an evaporator. Such a refrigerator may include a freezing compartment for storing items in a frozen state, and a refrigerating compartment for storing items at low temperature. A Kimchi refrigerator may store items such as Kimchi or vegetables in a fresh state.

A refrigerator may include a plurality of doors, at least one of the plurality of doors being connected to a refrigerator body by hinges to open or close a front side of the refrigerator body. In addition to the hinged door, the refrigerator may include a drawer type door mounted to a front wall of a drawer slidably installed in the refrigerator. Items of various sizes and shapes may be stored in the freezing and refrigerating compartments, which may include a plurality of racks to vertically partition the storage compartment to receive such items. One or more baskets may be attached to a refrigerator door and/or a freezer door to store frequently used items.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. Wherever possible, the same reference numbers will be used throughout the drawings to refer to the same or like parts, and a repeated description thereof will be omitted.

Figure 1:
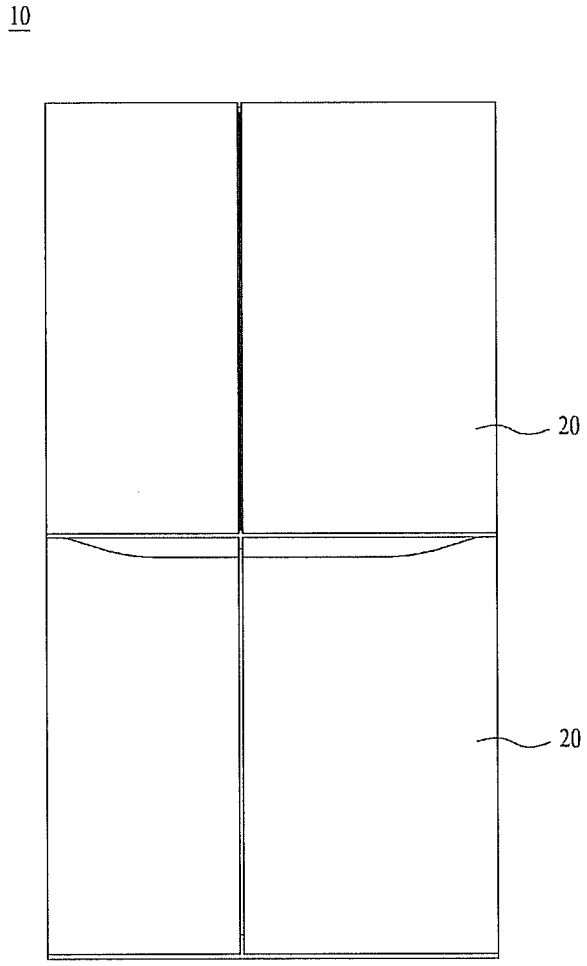
FIG. 1 is a front view of a refrigerator according to an exemplary embodiment as broadly described herein.
Figure 2:
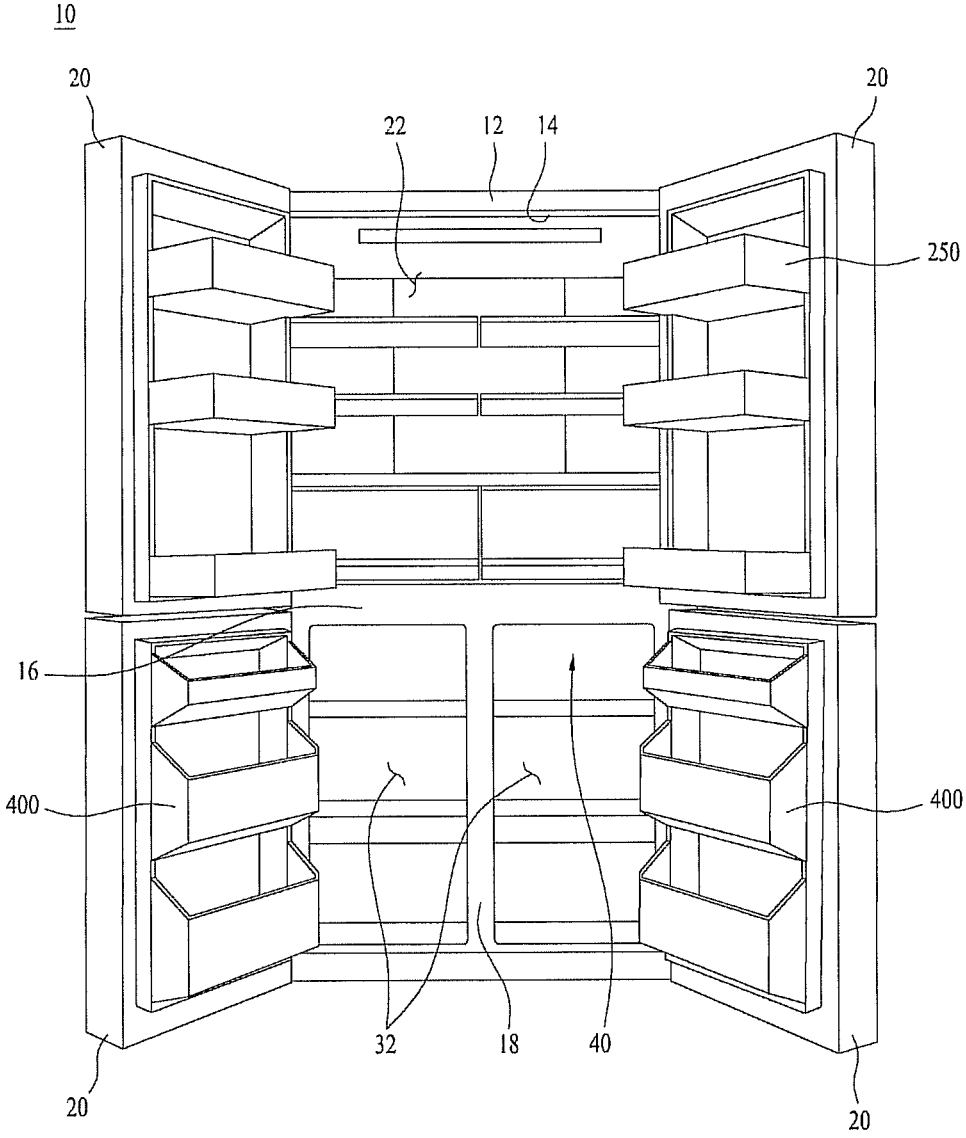
FIG. 2 is a front view of the refrigerator shown in FIG. 1, with its doors open.
Figure 3:
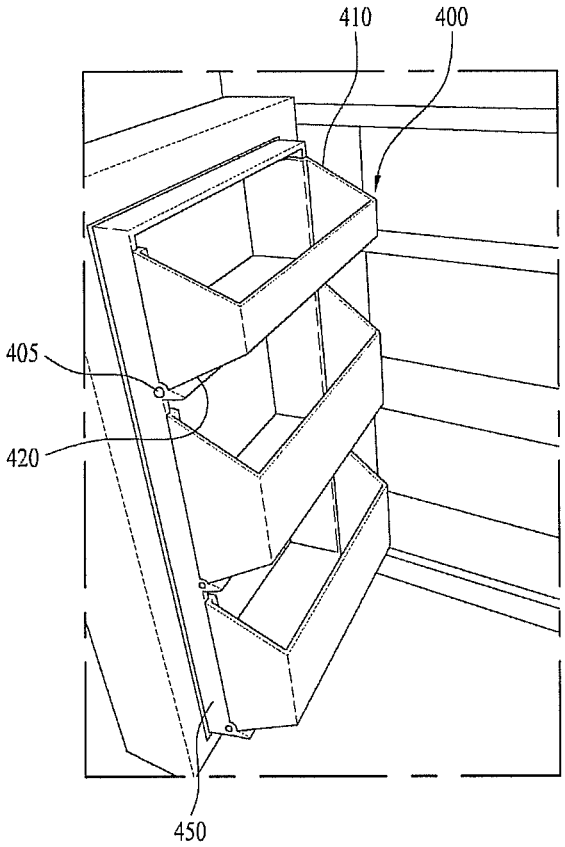
FIGS. 3 and 4 are perspective views baskets installed on a door of the refrigerator shown in FIGS. 1 and 2, in accordance with embodiments as broadly described herein.

In accordance with the refrigerator illustrated in the embodiment shown in FIGS. 1 and 2, the refrigerator, which is designated by reference numeral "10", is applicable not only to a top mount type refrigerator in which the inner space of the refrigerator is vertically partitioned to define a freezing compartment and a refrigerating compartment such that the freezing compartment is arranged above the refrigerating compartment, but also to a side-by-side type refrigerator in which the inner space of the refrigerator is laterally partitioned to define a freezing compartment and a refrigerating compartment such that the freezing compartment and refrigerating compartment are laterally arranged. Simply for ease of discussion and illustration embodiments will be described in conjunction with a bottom freezer type refrigerator. That is, the inner space of the exemplary refrigerator 10 is vertically partitioned to define a freezing compartment 32 positioned below the refrigerating compartment 22.

Generally, the freezing compartment 32 may be maintained at a sub-zero temperature, and the refrigerating compartment 22 may be maintained at a temperature relatively higher than that of the freezing compartment 32.

The refrigerator 10 may include a body which defines an outer appearance of the refrigerator 10 while also protecting mechanical devices received therein. The body of the refrigerator 10 may include an outer case 12 which defines an outer appearance of the refrigerator 10, and an inner case 14 which defines storage compartments therein, namely, the freezing compartment 32 and the refrigerating compartment 22. A certain space may be defined between the outer case 12 and the inner case 14. A passage for circulation of cold air may be formed in the space.

A machinery chamber may be formed in the space between the outer case 12 and the inner case 14 to accommodate a refrigerant cycle device for generating cold air through circulation of a refrigerant. Using the refrigerant cycle device, the interior of the refrigerator 10 may be maintained at low temperature to keep a desired freshness level of items stored in the refrigerator 10. The refrigerant cycle device may include, for example, a compressor for compressing a refrigerant, and an evaporator for changing the phase of the refrigerant from liquid to gas, to cause the refrigerant to exchange heat with the outside of the refrigerant cycle device.

The refrigerator 10 may include doors 20 for opening or closing the freezing compartment 32 and the refrigerating compartment 22. Each of the doors 20 may be pivotally mounted to the body of the refrigerator 10 at one end thereof by hinges. Each of the doors 20 may include a plurality of doors. That is, as shown in FIG. 2, each of the doors 20 may be configured such that it opens forward while being pivotally moved about opposite lateral edges of the refrigerator 10.

A barrier 16 may be positioned between the freezing compartment 32 and the refrigerating compartment 22, to partition the freezing compartment 32 and refrigerating compartment 22. The barrier 16 may be formed at the inner case 14 such that it has a certain thickness. The barrier 16 may extend horizontally to vertically partition the freezing compartment 32 and refrigerating compartment 22 such that the freezing compartment 32 and refrigerating compartment 22 are disposed below and above the barrier 16, respectively.

A partition wall 18 may be positioned in the freezing compartment 32, for example at a central portion thereof to partition the freezing compartment 32 into two separate spaces. The partition wall 18 is may be vertically installed at the inner case 14 such that the freezing compartment 32 is divided into two laterally arranged compartments. In this case, the freezing compartment door 30 may include two doors for opening or closing respective freezing compartments 32.

In the embodiment shown in FIGS. 1 and 2, there is no partition wall installed in the refrigerating compartment 22 to laterally partition the refrigerating compartment 22. However, a partition wall may be installed in the refrigerating compartment 22, as in the freezing compartment 32.

Baskets 250 and 400 may be provided at the doors 20. Each of the baskets 250 and 400 may have relatively generous storage capacity with easy access thereto.

Hereinafter, the baskets 400 will be described in detail with reference to FIGS. 3 to 6. As shown in FIGS. 3 to 6, the baskets 400 may include a side frame 450, door racks 440, and hinge shafts 405. For ease of description, the following description will be provided in conjunction with one basket 400 and one door rack 440.

The basket 400 according to the illustrated embodiment may have a structure capable of retaining items securely therein while storing a large amount of items contained in containers having non-uniform shapes such as, for example, vinyl bags or zipper bags while also allowing items to be easily put into and taken out of the basket 400. The basket 400 may have a box shape with an opening at a top side thereof. The basket 400 may also have an inclination 420 at a bottom thereof such that the bottom is upwardly inclined as it extends away from the inner surface of the door.

Figure 4:
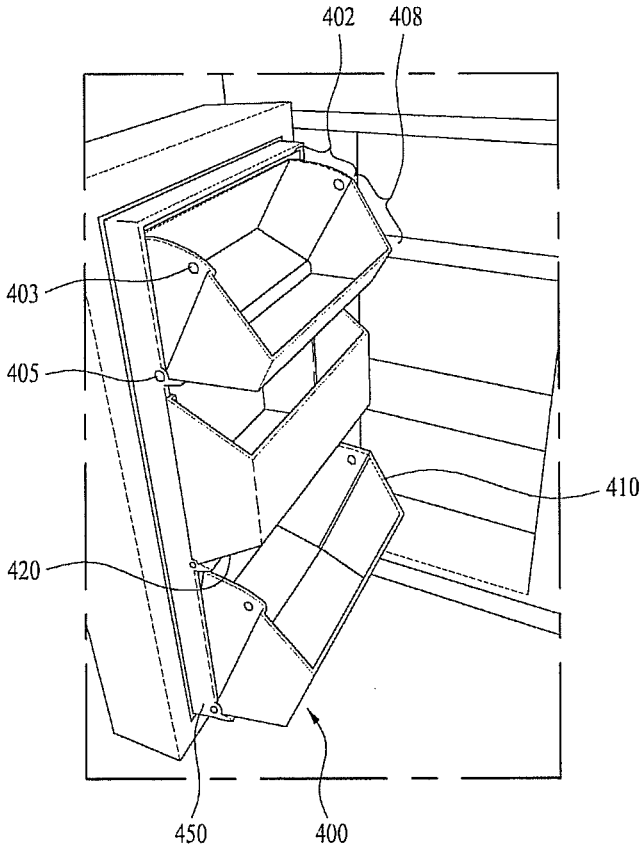

When a plurality of baskets 400 are vertically arranged, as shown in FIG. 4, a space may be provided at an entrance of a lower one of a pair of vertically-adjacent baskets 400 by the inclined bottom surface 420 of the upper basket 400, so that the bottom of the upper basket 400 does not interfere with putting items into or removing items from the lower basket 400. By virtue of this inclination structure, the baskets 400 may have a greater depth, that is, a side vertical height, than otherwise possible. It may also be possible to reduce the vertical spacing of the baskets 400. In other words, an increase in storage space may be achieved in that the size of each basket 400 may be increased without a reduction in the number of the baskets 400 installed at the door 20, as the baskets 400 may be installed closely to each other, but without impeding access.

It may not be necessary for the lowermost one of the baskets 400 to have an inclined bottom surface 420 at the bottom thereof because there is no basket 400 disposed beneath the lowermost basket 400.

Figure 6:
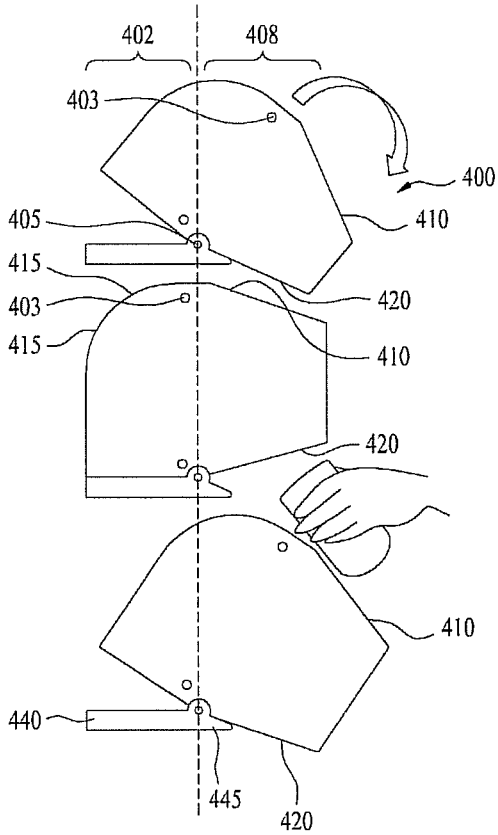

The basket 400 may also have an inclination 410 at an upper end of opposite side walls thereof such that the upper end is downwardly inclined as it extends away from the inner surface of the door, as shown in FIG. 6. The inclination 410 at the top of the basket 400 may enlarge access to the open entrance area of the basket 400, especially in combination with the inclined bottom surface of the basket above it. By virtue of this top side inclination 410, it may also be possible to increase the height of each side wall of the basket 400 at a portion of the side wall.

That is, the top inclination 410 may provide additional space and field of view for putting items into and removing items from the basket 400. It may also be possible to increase the amount of items stored in the basket 400, as a height of the portion of the side wall is increased to keep items securely stored therein. For example, items contained in vinyl bags may be stacked in the basket 400, with the increased height side wall portions helping these irregularly shaped items remain in the basket 400 without falling out.

The door rack 440 may be a plate-shaped member that protrudes from the inner surface of the door 20. The door rack 440 may have a flat upper surface to which the basket 400 may be coupled, to stably store items therein.

The door rack 440 may include a hinge shaft 405 rotatably mounted at a free end of the door rack 440. The basket 400 may be pivotally coupled to the door rack 440 at an intermediate portion of the basket 400 by the hinge shaft 405 such that it is pivotable about the hinge shaft 405.

Figure 5:
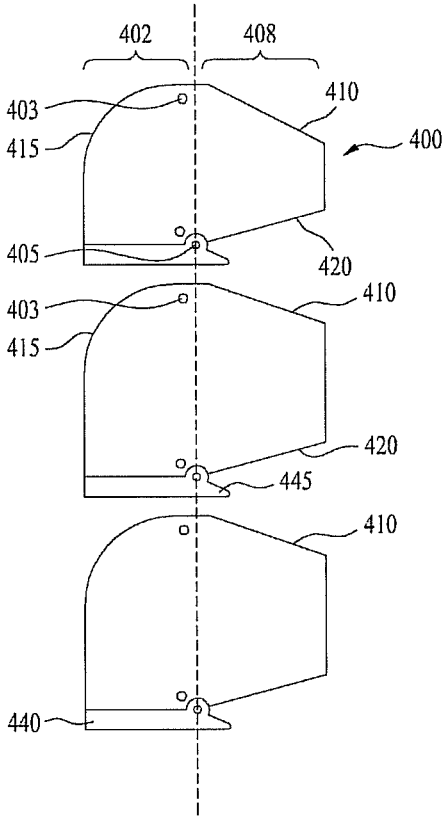
FIGS. 5 and 6 are side views of the baskets shown in FIG. 4.

The basket 400 may be divided into a first storage portion 402 and a second storage portion 408 with respect to the hinge shaft 405. As shown in FIGS. 5 and 6, the first storage portion 402 may correspond to a portion of the basket 400 supported by the door rack 440 in a non-rotated state of the basket 400, whereas the second storage portion 408 may protrude outward from the door rack 440.

When the basket 400 is pivotally coupled to the door rack 440 by the hinge shaft 405 the basket 400 may move pivotally along a relatively large arc. When the arc is relatively large/wide, it may be necessary to provide an increased space for the basket 400 in the refrigerator 10.

To this end, the basket 400 may be pivotally coupled to the hinge shaft 405 at a position which is not excessively biased toward one side or the other side (i.e., toward the front side or the rear side) of the bottom of the basket 400. Thus, the basket 400 may be divided into the first storage portion 402, which is seated on the door rack 440, and the second storage portion 408, which protrudes outward from the door rack 440, as described above.

The inclined bottom surface 420 may be provided at the bottom of the second storage portion 408. In the embodiment illustrated in FIGS. 4 and 6, the bottom inclined surface 420 is provided at the bottom of the second storage portion 408 because the second storage portion 408 moves pivotally about the hinge shaft 405, in order to prevent the second storage portion 408 of an upper one of a pair of vertically-adjacent baskets 400 from striking the lower basket 400 during opening of the upper basket 400.

The bottom inclined surface 420 may also be provided at the bottom of the first storage portion 402. However, in the embodiment shown in FIGS. 4-6, the bottom of the first storage portion 402 is flat to allow the first storage portion 402 to be stably seated on the door rack 440.

In order to limit the pivotal movement range of the basket 400, the door rack 440 may also include a stopper 445 that protrudes from the free end of the door rack 440. As shown in FIGS. 5 and 6, the stopper 445 may protrude from the free end of the door rack 440 and have an inclination at an upper surface thereof.

The stopper 445 may control pivotal movement of the basket 400 such that the inclined bottom surface 420 of the second storage portion 408 comes into contact with the upper surface of the stopper 445 during pivotal movement of the basket 400, thereby preventing further pivotal movement of the basket 400. The allowable pivot angle of the basket 400 may be based on the inclination of the upper surface of the stopper 445.

In order to prevent a lower basket 400 from striking the door rack 440 supporting the basket 400 above it during pivotal movement of the lower basket 400 about the hinge shaft 405, a top of the first storage portion 402 may extend at a downward incline from the intermediate portion of the top edge of the basket 400 toward the inner surface of the door. That is, as shown in FIGS. 5 and 6, the top 415 of the first storage portion 402 may have a gentle curve shape such that one side of the top 415, opposite to the second storage portion 408, is lower than the other side of the top 415, adjacent to the second storage portion 408. This structure may prevent the lower basket 400 from striking the door rack 440 supporting the upper basket 400 during pivotal movement of the lower basket 400 about the hinge shaft 405.

Thus, a maximum side wall height may be at the intermediate portion of the side all of the basket 400 where it is coupled to the shaft 405, and the minimum height may be at the front end of the basket 400, where the inclined bottom surface 420 and the top inclination 410 meet the front wall of the basket 400. In certain embodiments, this minimum height may be, for example, 60-80% of the maximum height.

The side frame 450 may partially cover each side wall of the basket 400, to guide stable rotation of the basket 400. To avoid unintentional opening or closing of the basket 400, the basket 400 may have a concave portion having a depth corresponding to the thickness of the side frame 450 formed at leach side wall thereof so that the side surfaces of the basket 400 and side frame 450 are flush with each other.

If the basket 400 is rotated about the hinge shaft 405 and opened, even slightly by a slight impact, items stored in the basket 400 may be dropped from the basket 400. Therefore, the basket 400 may be maintained in a seated position on the door rack 440, unless items are being put into or taken out of the basket 400.

Figure 7:
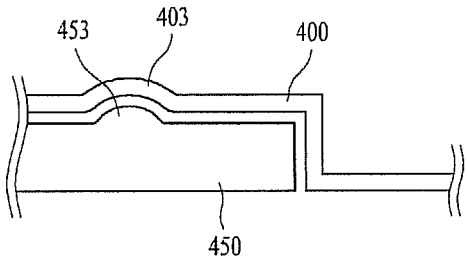
FIG. 7 is a sectional view of an engagement portion of the basket and an engagement portion of a side frame, in accordance with an embodiment as broadly described herein.

To this end, a structure for engaging the basket 400 with the side frame 450 may be provided. In detail, as shown in FIG. 7, a first engagement portion 453 may be formed at an inner surface of each vertical portion of the side frame 450, and a second engagement portion 403 may be formed at an outer surface of each side wall of the basket 400 such that the second engagement portion 403 is engaged with the first engagement portion 453 when the first storage portion 402 of the basket 400 is completely inserted into a space defined by the inner surface of the door 20.

The first engagement portion 453 and second engagement portion 403 may be structured to be engagable and disengagable by a relatively slight force. For example, as shown in FIG. 7, when the first engagement portion 453 and second engagement portion 403 have gently-curved shapes, engagement and disengagement thereof may be achieved through slight pushing and pulling.

Alternatively, the center of weight of the basket 400 may be positioned at the side of the basket corresponding to the first storage portion 402. When items are put into the basket 400, they may be mainly stored in the first storage portion 402 due to the inclined bottom surface 420 of the second storage portion 408. As a result, when items are put into the basket 400, the first storage portion 402 becomes heavier than the second storage portion 408 and, as such, the center of weight of the basket 400 is naturally shifted to the side of the first storage portion 402.

In certain embodiments, a relatively heavy weight may be embedded in the bottom of the first storage portion 402, to position the center of weight of the basket 400 at the side of the basket corresponding to the first storage portion 402, so that even when the basket 400 is empty, it may be possible to prevent the basket 400 from pivoting unintentionally.

As apparent from the above description, the basket may have an inclination at the bottom thereof so that, when a plurality of baskets are vertically arranged, an upper one of a pair of vertically-adjacent baskets may not interfere with the lower basket, even when the baskets have an increased depth. Accordingly, it may be possible to increase the capacity of the basket. Also, the basket may receive containers having non-uniform shapes, for example, vinyl bags or zipper bags.

The basket may also have an inclination at the top thereof to provide for a relatively wide entrance of the basket to facilitate the storage and removal of items even when the basket has an increased side profile to accommodate storage item therein to the basket's fullest capacity.

In addition, when a plurality of baskets are vertically arranged, the top of a lower one of a pair of vertically-adjacent baskets may be exposed by virtue of rotation about a hinge structure, rather than being obstructed by the upper basket to facilitate the storage and removal of items even when the baskets have an increased size.

A refrigerator is provided including a large-capacity basket attached to a refrigerator door while having enhanced space utility to store food articles contained in containers having non-uniform shapes such as vinyl bags or zipper bags.

A refrigerator as embodied and broadly described herein may include a cabinet provided with a storage space opened at one side thereof, a door pivotally coupled, at one end thereof, to the cabinet, to open or close the cabinet, and at least one basket coupled, at one side thereof, to the door, the basket having a bottom upwardly inclined from one side thereof adjacent to the door to the other side thereof opposite to the door.

The basket may have opposite side walls each having an upper end downwardly inclined from one side thereof adjacent to the door to the other side thereof opposite to the door.

The refrigerator may also include at least one door rack protruded from the door and provided with a hinge shaft mounted to a free end of the door rack. The basket may include a first storage portion coupled to the hinge shaft and disposed on the door rack, and a second storage portion protruded outwardly of the door rack.

The inclination of the bottom of the basket may be formed at the second storage portion.

The inclination of the upper end of each wall of the basket may be formed at the second storage portion.

The door may include a side frame for covering portions of side walls of the basket. The side wall portions of the basket covered by the side frame may be concaved to a depth corresponding to a thickness of the side frame.

The side frame may include a first engagement portion formed at a portion of the side frame facing each of the side walls of the basket. The basket may include a second engagement portion formed at each of the side walls of the basket such that the second engagement portion is engaged with the first engagement portion when the first storage portion of the basket is completely inserted into an inside of the side frame.

The door rack may include a stopper formed at a free end of the door rack to be protruded outwardly of the first storage portion of the basket, the stopper having an inclination at an upper surface thereof.

The basket may have a center of weight at the first storage portion.

The first storage portion may have a top downwardly inclined from one side of the first storage portion adjacent to the door to the other side of the first storage portion opposite to the door.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet defining a storage space that is opened at one side thereof;

a door rotatably coupled to the cabinet to open and close the opened side of the storage space;

a rack provided at an interior side of the door, and a basket rotatably coupled to the rack by a hinge structure, the basket comprising:

a bottom wall extending between two opposite lateral side walls, the two opposite lateral side walls extending upward from opposite longitudinal ends of the bottom wall; and a front wall extending upward from a front end of the bottom wall, wherein the bottom wall comprises:

a first panel positioned corresponding to the rack; and a second panel extending upward at an incline from and end of the first panel, wherein a top end of each of the two opposite lateral side walls each include a first downwardly inclined portion, wherein the rack has a first end thereof coupled to and extending outward from the interior side of the door, wherein the hinge structure rotatably coupling the basket to the rack comprises a hinge shaft installed at a second end of the rack opposite the first end thereof, and wherein the basket is rotatably coupled to the rack by the hinge shaft at an intermediate portion of the two opposite lateral side wall, and wherein the basket comprises a first storage portion positioned on the rack, and a second storage portion that protrudes outward form the rack, and wherein the first panel of the bottom wall of the basket corresponds to the first storage portion, and the second panel of the bottom wall of the basket corresponds to the second storage portion.

2. The refrigerator of claim 1, wherein the first downwardly inclined portion of the top end of each of the two opposite lateral side walls of the basket corresponds to the second storage portion.

3. The refrigerator of claim 1, further comprising a side frame provided on the interior side of the door and partially covering the two opposite lateral side walls of the basket, wherein a portion of the two opposite lateral side walls covered by the side frame are concave to a depth corresponding to a thickness of the side frame.

4. The refrigerator of claim 3, wherein the side frame comprises a plurality of first engagement portions each formed at a portion of the side frame facing a corresponding lateral side wall of the basket, and wherein the basket comprises a second engagement portion formed at each of the two opposite lateral side walls such that the second engagement portion is engaged with the first engagement portion when the basket is rotated into the side frame, and is disengaged when the basket is rotated away from the side frame.

5. The refrigerator of claim 1, wherein the rack comprises a stopper extending forward from the hinge shaft, wherein the stopper includes an inclined upper surface that selectively contacts the second panel of the bottom wall of the basket as the basket rotates about the hinge shaft to restrict a rotation angle of the basket.

6. The refrigerator of claim 1, wherein the basket has a center of weight at the first storage portion adjacent to the hinge shaft.

7. The refrigerator of claim 1, wherein the top end of the two opposite lateral side walls each include a second downwardly inclined portion extending from the intermediate portion to the first end thereof, such that the second downwardly inclined portion of the top end of the two opposite lateral side walls corresponds to the first storage portion of the basket, and the first downwardly inclined portion of the top end of the two opposite lateral side walls and the upwardly inclined panel of the bottom wall correspond to the second storage portion of the basket.

8. The refrigerator of claim 7, wherein a height at the intermediate portion of each of the two opposite lateral side walls of the basket is greater than a height at the second end of the respective lateral side wall.

9. The refrigerator of claim 8, wherein the height of the second end of each of the two opposite lateral side walls is approximately 80% of the height at the intermediate portion thereof.

10. The refrigerator of claim 1, wherein a dimension of the second storage portion in a front to rear direction is greater than a dimension of the first storage portion in the front to rear direction.

11. The refrigerator of claim 1, wherein a width of the second storage portion is greater than a width of the first storage portion.

12. A refrigerator, comprising:

a cabinet defining an interior space therein that is opened on one side thereof;

a door rotatably coupled to the cabinet to open and close the opened side of the inner space;

a plurality of racks coupled to an interior side of the door;

a plurality of baskets respectively coupled to the plurality of racks, each of the plurality of baskets comprising:

a front wall provided at an access side of the basket;

a bottom wall that is received on a corresponding rack of the plurality of racks, the bottom wall including a bottom inclined portion extending at an upward incline from an intermediate portion thereof to a bottom end of the front wall; and a pair of lateral side walls respectively provided at opposite ends of the bottom wall, a top end of each of the pair of lateral side walls including a top inclined portion extending at a downward incline from an intermediate portion thereof to a top end of the front wall, wherein each of the plurality of baskets is coupled to a respective rack of the plurality of racks by a shaft that extends from the rack into a corresponding one of the pair of lateral side walls of the basket at the intermediate portion thereof such that each basket is rotatable about its respective shaft, and wherein each of the plurality of racks comprises a stopper extending forward from the respective shaft, the stopper including an inclined upper surface that selectively contacts the respective basket as the basket rotates about the shaft to restrict a rotation angle of the basket.

13. The refrigerator of claim 12, wherein a height of each of the pair of lateral side walls at the intermediate portion is a maximum height that is greater than a height of the front wall of each of the plurality of baskets.

14. The refrigerator of claim 12, wherein the shaft is coupled to a lower portion of the corresponding lateral side wall proximate to the bottom wall such that the basket rotates about a bottom end thereof.

15. The refrigerator of claim 14, wherein each of the plurality of baskets further comprises a rear wall provided at a door side of the basket, wherein the top end of each of the pair of lateral side walls includes a curved portion curving downward from the intermediate portion thereof to the rear wall.

16. A refrigerator, comprising:

a cabinet defining a storage space that is opened at one side thereof;

a door rotatably coupled to the cabinet to open and close the opened side of the storage space;

a rack provided at the door; and a basket rotatably coupled to the rack by a hinge structure, the basket comprising:

a bottom wall;

two lateral side walls extending upward from opposite ends of the bottom wall, wherein a top end of each of the two lateral side walls are downwardly inclined; and a front wall extending upward from a front end of the bottom wall, wherein the bottom wall comprises:

a first panel positioned at an inner side of the hinge structure, between the hinge structure and the door; and a second panel positioned at an outer side of the hinge structure, between the hinge structure and the front wall, and extending upward at an incline from an end of the first panel, wherein the rack has a first end thereof coupled to and extending outward from the interior side of the door, wherein the hinge structure rotatably coupling the basket to the rack comprises a hinge shaft installed at a second end of the rack opposite the first end thereof, and wherein the basket is rotatably coupled to the rack by the hinge shaft at an intermediate portion of the two opposite lateral side wall, wherein the basket comprises a first storage portion positioned on the rack, and a second storage portion that protrudes outward form the rack, and wherein the first panel of the bottom wall of the basket corresponds to the first storage portion, and the second panel of the bottom wall of the basket corresponds to the second storage portion.

* * * * *